US007089904B2

(12) United States Patent
Morii et al.

(10) Patent No.: US 7,089,904 B2
(45) Date of Patent: Aug. 15, 2006

(54) LUBRICATING STRUCTURE FOR ENGINES, LUBRICATING STRUCTURE FOR ENGINES FOR SNOW VEHICLES, AND SNOW VEHICLE

(75) Inventors: Hideshi Morii, Hamamatsu (JP); Toshio Hayashi, Hamamatsu (JP); Osamu Sekimoto, Hamamatsu (JP); Yuji Sonoda, Shizuoka-Ken (JP)

(73) Assignee: Suzuki Motor Corporation, Hamamatsu (JP)

( * ) Notice: Subject to any disclaimer, the term of this patent is extended or adjusted under 35 U.S.C. 154(b) by 234 days.

(21) Appl. No.: 10/863,606

(22) Filed: Jun. 8, 2004

(65) Prior Publication Data

US 2004/0250789 A1 Dec. 16, 2004

(30) Foreign Application Priority Data

Jun. 13, 2003 (JP) ..... 2003-168837

(51) Int. Cl.
*F01M 1/00* (2006.01)

(52) U.S. Cl. ..... 123/196 R; 123/192.2; 123/195 C; 184/6.5

(58) Field of Classification Search ..... 123/196 R, 123/192.2, 195 C; 184/6.5
See application file for complete search history.

(56) References Cited

FOREIGN PATENT DOCUMENTS

JP 8-177484 A 7/1996
JP 2001-280111 A 10/2001

*Primary Examiner*—Noah P. Kamen
*Assistant Examiner*—Katrina Harris
(74) *Attorney, Agent, or Firm*—Frishauf, Holtz, Goodman & Chick, P.C.

(57) ABSTRACT

A lubricating structure for engines, wherein an oil feed pump and an oil recovery pump are disposed so as to avoid interference between the oil feed and recovery pumps and a clutch mechanism and an increase in the size of the engine. The clutch mechanism 38 is disposed at a location toward a left end of a crankshaft 7 as an output shaft 7*a*, which is rotatably supported between an upper crankcase 5 and a lower crankcase 6, that is, disposed on a left side of an engine room. A magnet cover 60 is fixed to right side parts of the two crankcases 5, 6. A magnet MG is disposed between the two crankcases 5, 6 and the magnet cover 60 at a location toward a right end 7*b* of the crankshaft 7. An oil pump FEP for feeding lubricating oil is disposed between the two crankcases 5, 6 and the magnet cover 60, and an oil pump SCP for recovering lubricating oil is disposed between the two crankcases 5, 6 and the magnet cover 60.

9 Claims, 16 Drawing Sheets

LUBRICATING STRUCTURE FOR ENGINES, LUBRICATING STRUCTURE FOR ENGINES FOR SNOW VEHICLES, AND SNOW VEHICLE

BACKGROUND OF THE INVENTION

1. Field of the Invention

The present invention relates to a lubricating structure for engines, a lubricating structure for engines for snow vehicles, and a snow vehicle, wherein dry sump lubrication of a four-cycle engine is performed.

2. Description of the Related Art

In recent years, more and more four-cycle engines have come to be used for snow vehicles, and there have been proposed four-cycle engines including a dry sump lubricating structure and a clutch mechanism implemented e.g. by a constantly variable transmission. A lubricating structure in an engine of this type is generally provided with an oil feed pump for feeding lubricating oil and an oil recovery pump for recovering lubricating oil.

In designing the arrangement of the two oil pumps in the lubricating structure, it is necessary to take into account steering stability of the vehicle, reduction of the size of the engine, prevention of interference with other components, and-so forth. For example, in the case where the clutch mechanism is disposed on the output shaft side of the crankshaft, it is not preferable, with a view to avoidance of interference with the clutch mechanism, that the oil feed pump and the oil recovery pump are disposed on the output shaft side of the crankshaft.

In Japanese Laid-Open Patent Publication (Kokai) No. 2001-280111, it is disclosed that oil pumps are disposed such that the arrangement of an oil filter and communication passages between the oil pumps and the oil filter is designed so as to facilitate machining of oil passages and reduce the size of the engine.

Some snow vehicles with four-cycle engines are provided with a balancer shaft. In such a snow vehicle, the balancer shaft is normally rotatably supported in a crankcase. A balancer shaft requires lubrication, and particularly when two balancer shafts are provided, the arrangement of oil passages for lubrication influences not only the degree of difficulty in passage machining but also space saving within the engine. Therefore, efficient designing of passages is desired.

However, in the above-mentioned dry sump lubricating structure, if the oil pumps are disposed at locations away from the crankshaft, e.g. in a lower part of the engine, and the crankshaft is used to drive the oil pumps, oil pump driven gears of an increased size have to be employed for speed reduction, which hinders saving of space within the engine. Further, in the case where a magnet device is provided on an end of the crankshaft opposite from the clutch mechanism, if it is designed such that the oil pumps are driven by the end of the crankshaft via gears and chains, the crankshaft inevitably has to be lengthened for allowing a driving force to be taken therefrom, which leads to an increase in the overall width of the engine.

Further, in a snow vehicle with a four-cycle engine, if oil passages are formed, for example, such that they extend from a main oil gallery to the two balancer shafts, the oil passages are complicated in structure, which not only makes passage machining difficult, but also requires an engine with an increased size for securing space for machining the passages.

In Japanese Laid-Open Patent Publication (Kokai) No. H08-177484, it is disclosed that a main oil gallery and a sub oil gallery are connected by a branch pipe. However, this needs provision of the additional branch pipe, and therefore it is not suitable for space saving.

Further, an oil filter provided in a snow vehicle with a four-cycle engine requires periodical replacement, and it is, therefore, necessary to dispose the oil filter at a location free from interference with other components and facilitating the replacement operation. For example, if the oil filter is disposed in a rear part (intake side) of a rearward-tilted engine, or if the filter is disposed in a front part (exhaust side) of a forward-tilted engine, the oil filter comes to be located below the engine, and therefore the replacement operation becomes difficult to carry out. Further, if the oil filter is disposed on the magnet device side, the space between the oil filter and a side wall of the engine room is small, which makes it difficult to mount or remove the oil filter. In addition, it becomes necessary to avoid interference of the oil filter with the clutch mechanism, an exhaust pipe, a steering post, an engine mount, and other components.

SUMMARY OF THE INVENTION

It is a first object of the present invention to provide a lubricating structure for an engine, wherein an oil feed pump and an oil recovery pump are disposed so as to avoid interference between the oil feed and recovery pumps and a clutch mechanism and an increase in the size of the engine.

It is a second object of the present invention to provide a lubricating structure for an engine for a snow vehicle, which is capable of suppressing an increase in the size of the engine.

It is a third object of the present invention to provide a snow vehicle, wherein interference between an oil filter and other components can be avoided, and at the same time operation of replacement of the oil filter can be facilitated.

To attain the first object, in a first aspect of the present invention, there is provided a lubricating structure for an engine, comprising a crankshaft (7) having one end (7*a*) and another end (7*b*), at least one crankcase (5, 6) having opposite side parts and rotatably supporting the crankshaft, a clutch mechanism (38) disposed at a location toward the one end of the crankshaft, a magnet cover (60) fixed to one of the opposite side parts of the crankcase, which is remote from the clutch mechanism, a magnet device (MG) disposed between the crankcase and the magnet cover at a location toward the other end of the crankshaft, an oil supply pump (FEP) disposed between the crankcase and the magnet cover, for supplying lubricating oil, and an oil recovery pump (SCP) disposed between the crankcase and the magnet cover, for recovering the lubricating oil.

With this arrangement of the lubricating structure according to the first aspect of the present invention, the oil feed pump and the oil recovery pump is provided so as to avoid interference between the oil feed and recovery pumps and the clutch mechanism and an increase in the size of the engine.

Preferably, at least one of the oil supply pump and the oil recovery pump is fixed to the magnet cover.

Preferably, the lubricating structure further comprises a balancer shaft (61) extending substantially parallel to the crankshaft, and the oil supply pump and the oil recovery pump are driven by the balancer shaft.

More preferably, the balancer shaft has an end (61*a*) remote from the clutch mechanism, the lubricating structure further comprising an oil pump drive gear (77) rigidly fitted on the end of the balancer shaft, and at least one of the oil supply pump and the oil recovery pump includes an oil pump body (81, 83), and an oil pump driven gear (82, 83), the oil pump drive gear being disposed at a location closer to an axial center (CP) of the balancer shaft than the oil pump body of the at least one of the oil supply pump and the oil recovery pump is.

To attain the second object, in a second aspect of the present invention, there is provided a lubricating structure for an engine for a snow vehicle, comprising an engine having a left side part and a right side part, a plurality of cylinders (94), a crankshaft (7) extending through the engine in a transverse direction thereof, a main oil gallery (90) formed in the engine at one of locations forward and rearward of the plurality of cylinders, a sub oil gallery (91) formed in the engine at the other of the locations forward and rearward of the plurality of cylinders, a piston cooling jet (93) connected to the sub oil gallery, at least one oil pump (FEP, SCP) provided in one of the left side part and the right side part of the engine, and an oil communication passage (95) formed in the other of the left side part and the right side part of the engine on a side of one cylinder remotest from the at least one oil pump, which is opposite from the at least one oil pump, the oil communication passage communicating with the main oil gallery and the sub oil gallery.

With this arrangement of the lubricating structure according to the second aspect of the present invention, the overall width of the engine can be reduced to thereby suppress an increase in the size of the engine.

Preferably, the lubricating structure further comprises a cooling water jacket (5*g*) formed in the engine at a location adjacent to the sub oil gallery.

To attain the second object, in a third aspect of the present invention, there is provided a lubricating structure for an engine for a snow vehicle, comprising a crankshaft extending through the engine in a transverse direction thereof, front and rear balancer shafts (61, 62) disposed at respective locations forward and rearward of the crankshaft and extending substantially parallel to the crankshaft, a crankcase (5) having a crankshaft-bearing part (103), a front balancer shaft-bearing part (101), and a rear balancer shaft-bearing part (102), the crankshaft-bearing part rotatably supporting the crankshaft, the front balancer shaft-bearing part rotatably supporting the front balancer shaft, and the rear balancer shaft-bearing part rotatably supporting the rear balancer shaft, a main oil gallery (90) formed in the crankcase at a location forward of the crankshaft and extending substantially parallel to the crankshaft, a first oil passage (97) formed in the crankcase and connecting between the main oil gallery and the front balancer shaft-bearing part, a second oil passage (98) formed in the crankcase and connecting between the main oil gallery and the crankshaft-bearing part, and at least one third oil passage (99, 100) formed in the crankcase and connecting between the crankshaft-bearing part and the rear balancer shaft-bearing part.

With this arrangement of the lubricating structure according to the third aspect of the present invention, the oil passages can be arranged in a concentrated and simplified fashion, for space saving to thereby suppress an increase in the size of the engine.

Preferably, the first to third oil passages are arranged in a generally M-shaped array, as viewed in an axial direction of the crankshaft.

To attain the third object, in a fourth aspect of the present invention, there is provided a snow vehicle comprising an engine having a front part, and a rear part and tilted longitudinally of the snow vehicle such that one of the front part and the rear part is located upward of the other, a crankshaft extending through the engine in a transverse direction thereof, a balancer shaft (61) disposed in the one of the front part and the rear part of the engine, which is located upward, and extending substantially parallel to the crankshaft, and an oil filter (56) disposed above the balancer shaft.

With this arrangement of the snow vehicle according to the fourth aspect of the present invention, interference between the oil filter and other components can be avoided, and at the same time operation of replacement of the oil filter can be facilitated.

The above and other objects, features, and advantages of the invention will become more apparent from the following detailed description taken in conjunction with the accompanying drawings.

FIG, 13 is a longitudinal cross-sectional view showing the engine.

Figure 13:
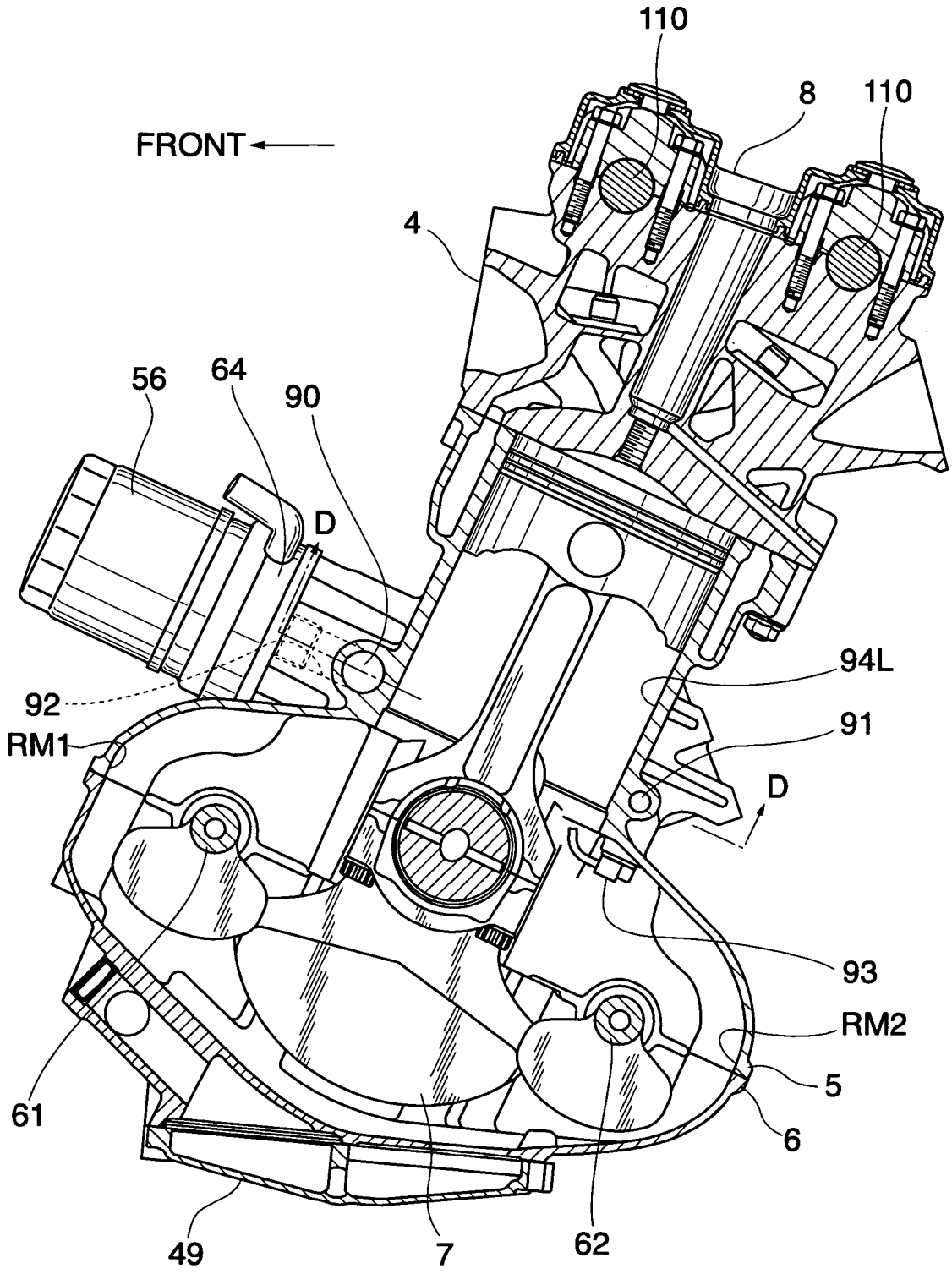
Figure 14:
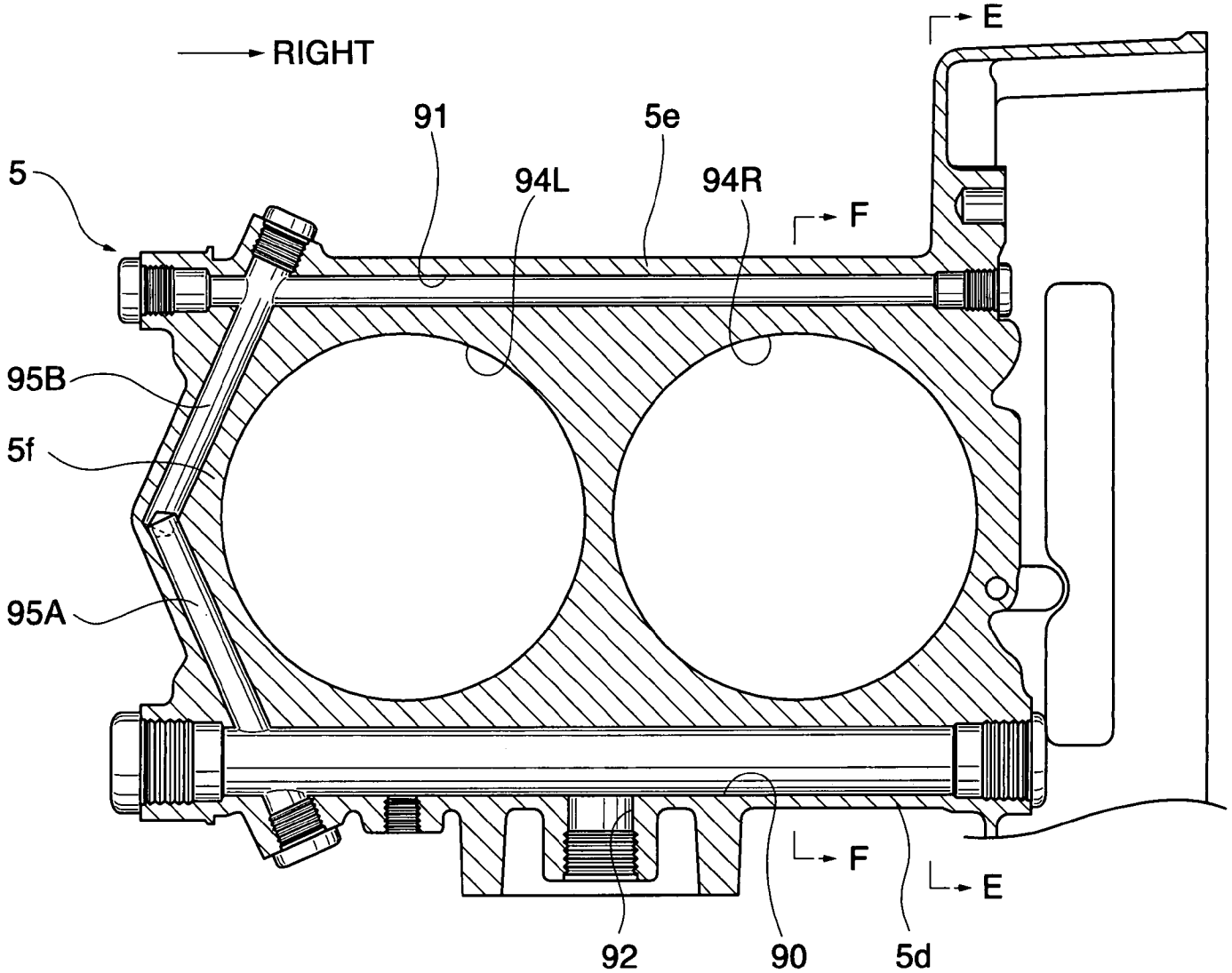
Figure 15:
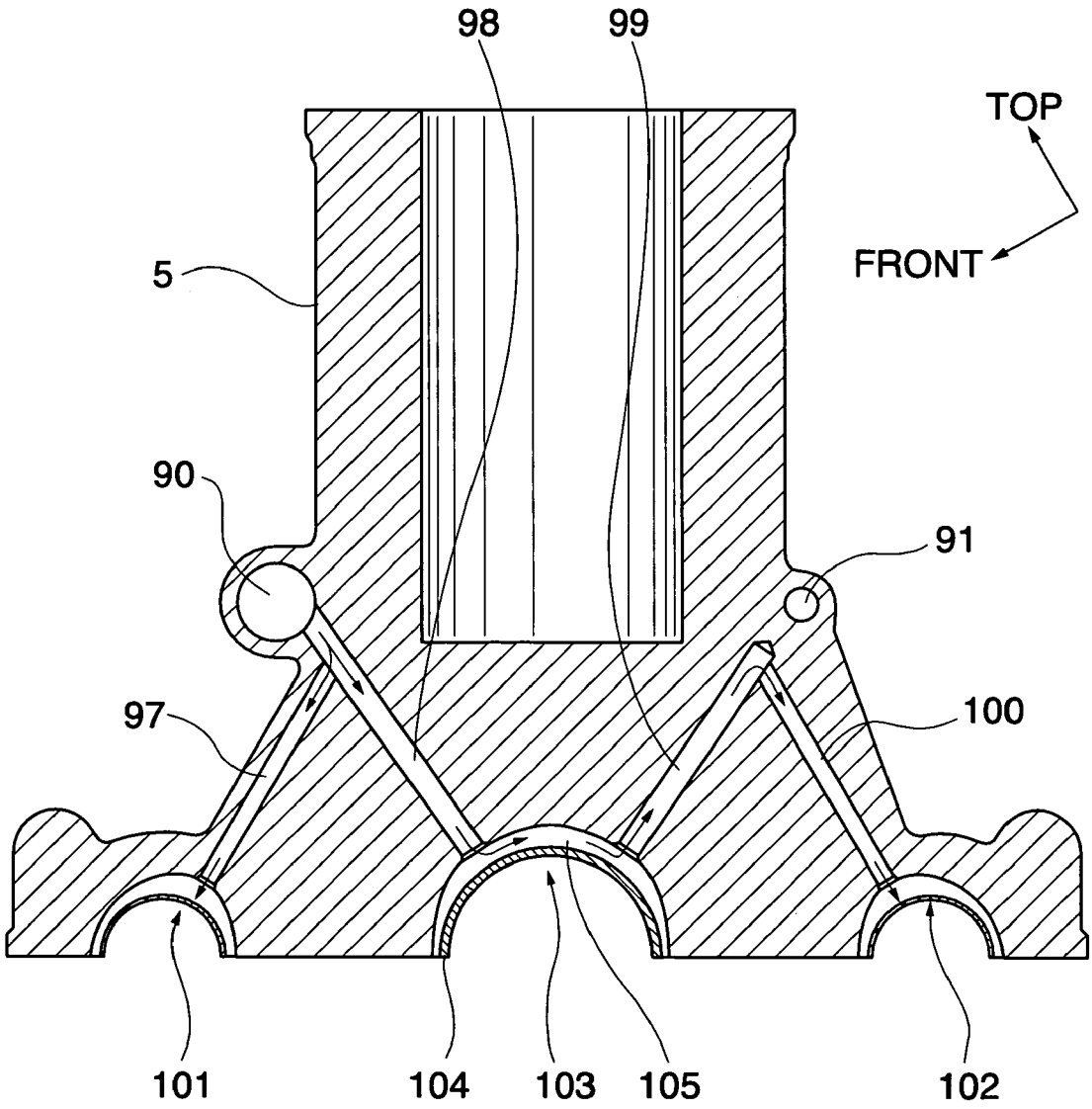

FIG. 14 is a cross-sectional view taken on line D—D of FIG. 13;

FIG. 15 is a cross-sectional view taken on line E—E of FIG. 14; and

Figure 16:
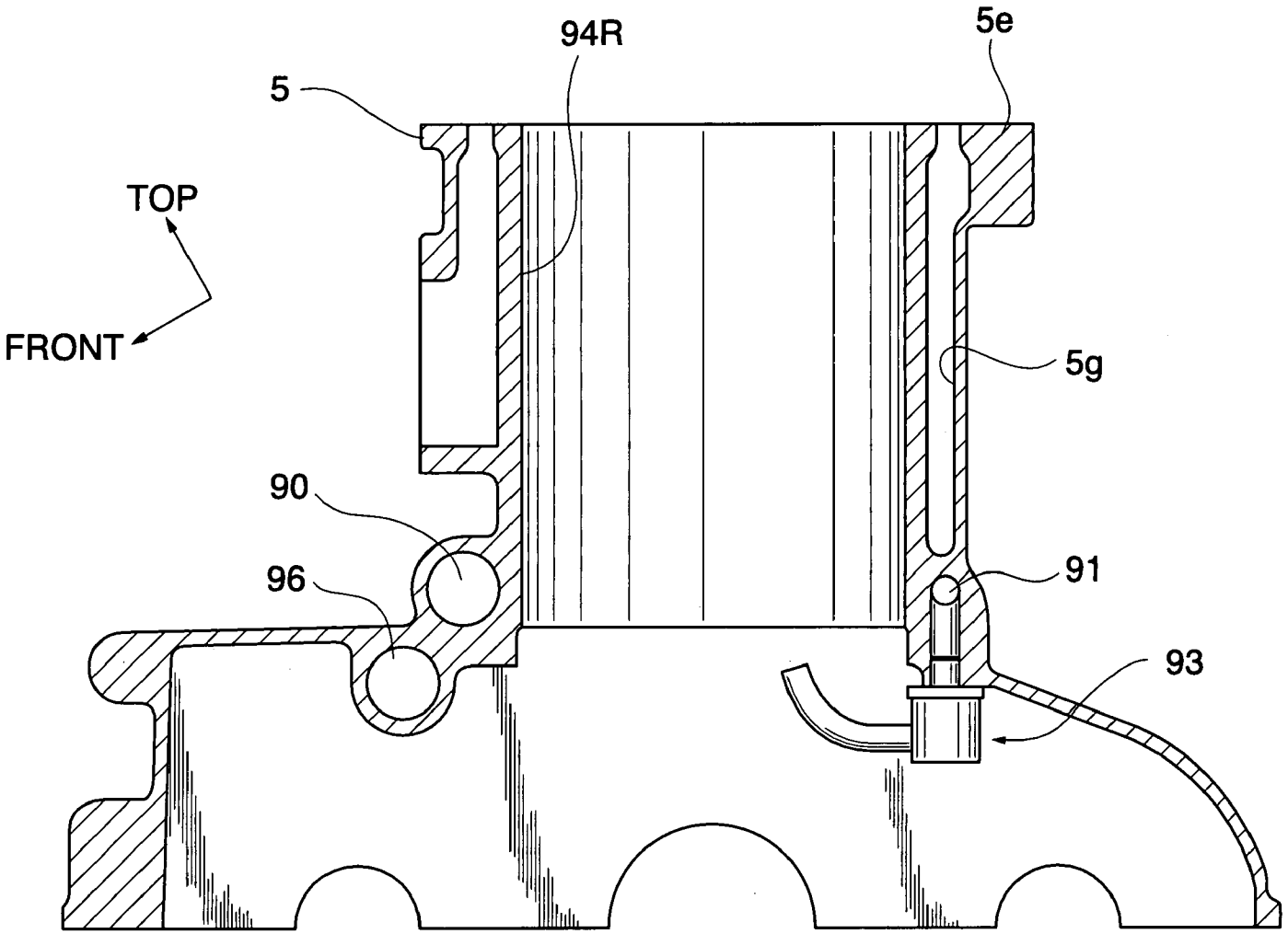

FIG. 16 is a cross-sectional view taken on line F—F of FIG. 14.

DETAILED DESCRIPTION OF THE PREFERRED EMBODIMENT

The present invention will now be described in detail below with reference to the accompanying drawings showing a preferred embodiment thereof.

Figure 1:
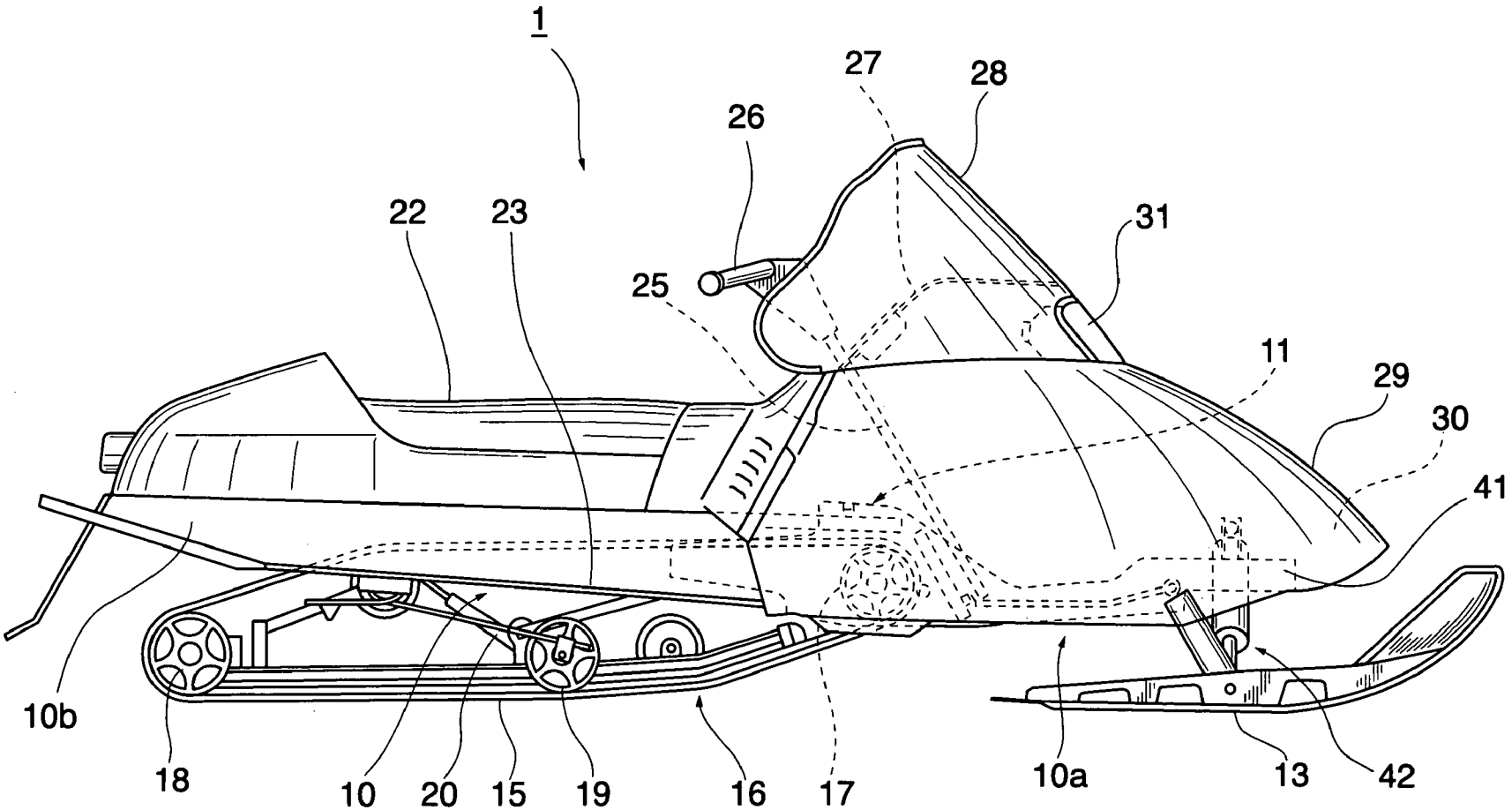
FIG. 1 is a side view showing a snow vehicle with a lubricating structure for an engine, according to an embodiment of the present invention.
Figure 2:
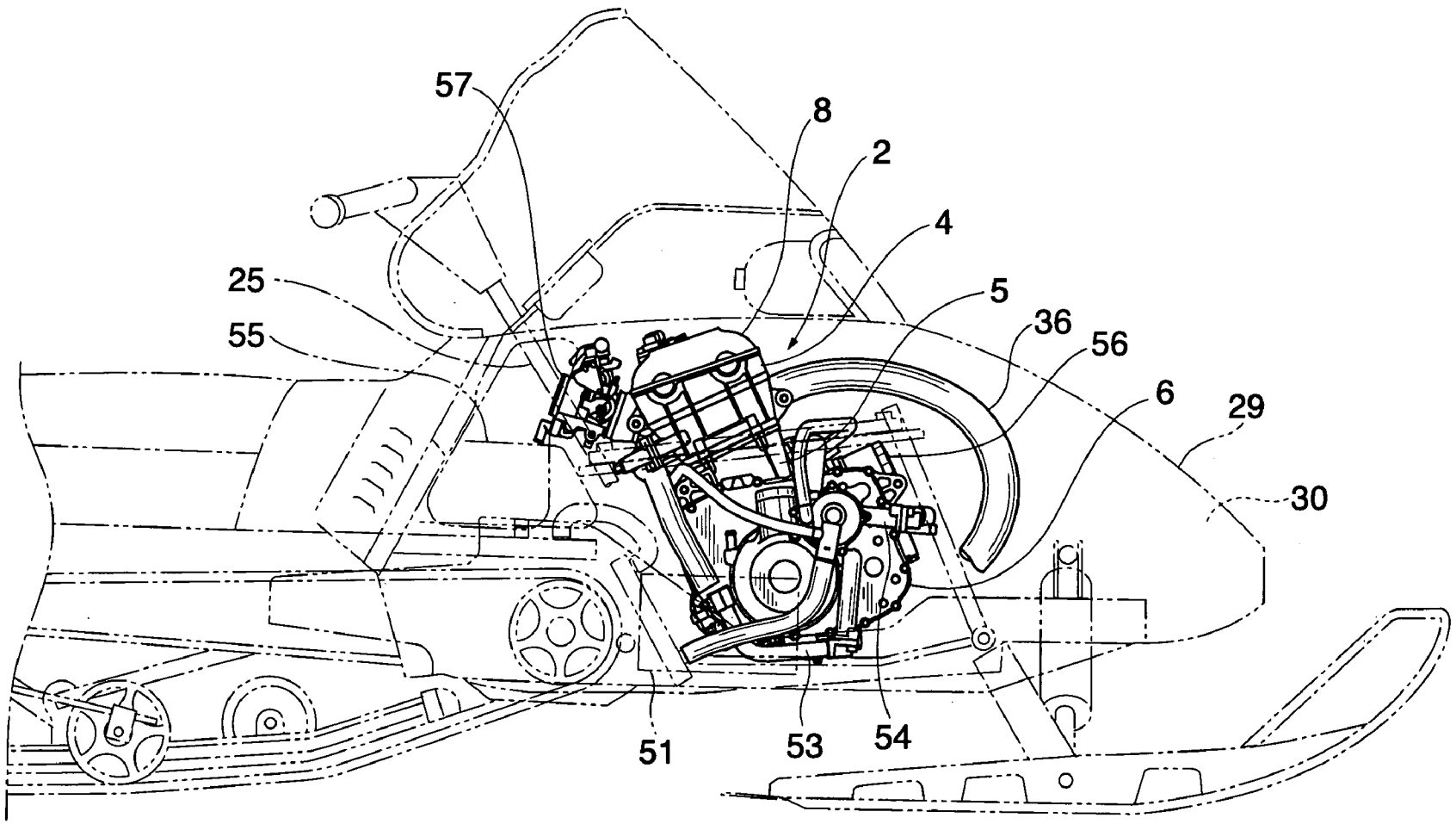
FIG. 2 is a perspective view showing the interior of an engine room as viewed from a lateral side of the vehicle.
Figure 3:
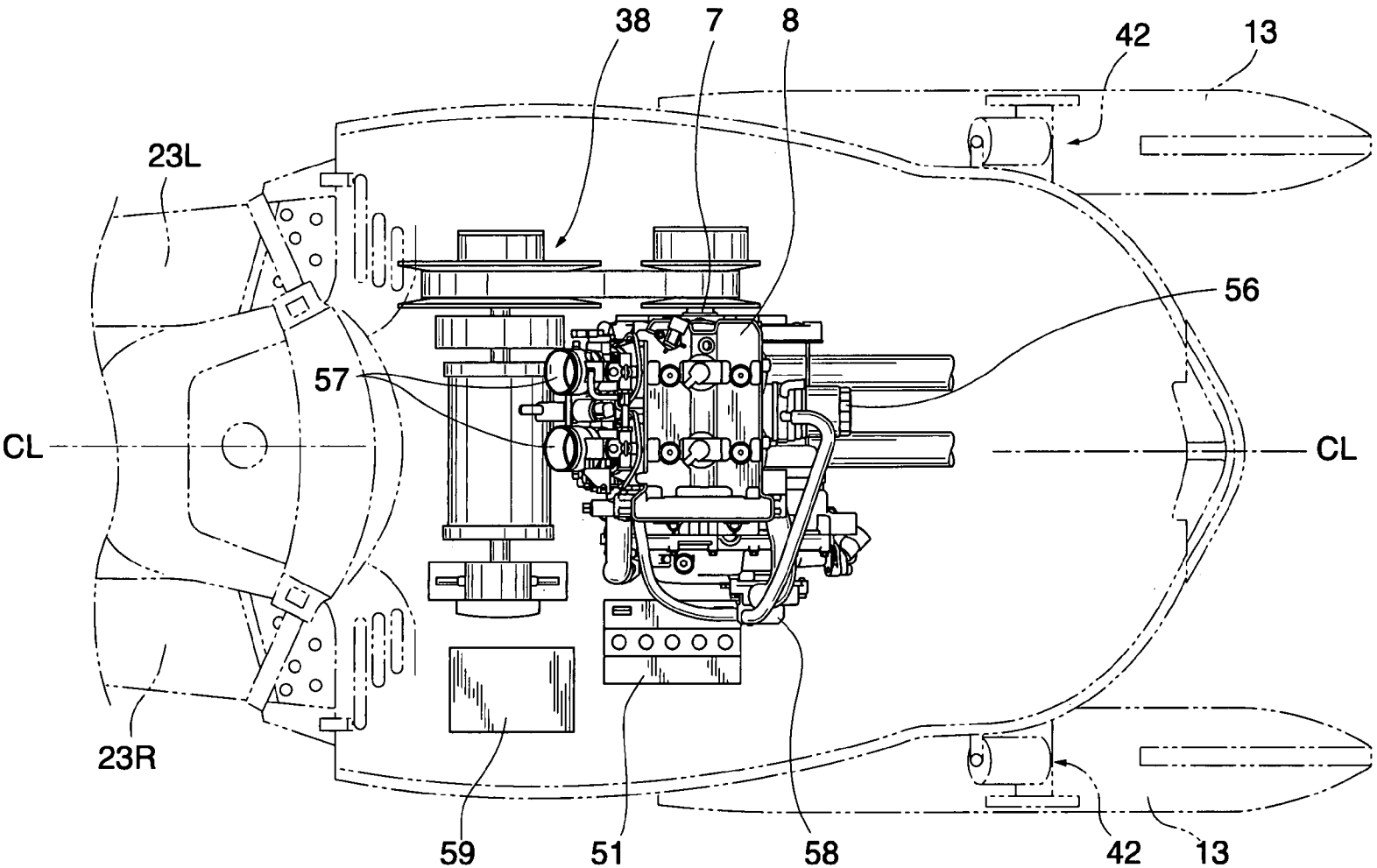
FIG. 3 is a perspective view showing the interior of the engine room as viewed from the top side of the vehicle.

FIG. 1 is a side view showing a snow vehicle with a lubricating structure for an engine, according to an embodiment of the present invention. FIG. 2 is a perspective view showing the interior of an engine room as viewed from a lateral side of the vehicle. FIG. 3 is a perspective view showing the interior of the engine room as viewed from the top side of the vehicle.

The snow vehicle 1 has a two-cylinder four-cycle engine (hereinafter simply referred to as "the engine") 2 installed in the engine room 30, referred to hereinafter. In the following description, the terms "front", "rear", "left", "right", "forward", "rearward", and "transverse" related to the snow vehicle 1 will be used as referring to respective directions defined with reference to the position of a driver on a driver's seat.

First, a description will be given of the whole construction of the snow vehicle 1.

Referring first to FIG. 1, the snow vehicle 1 includes a body frame 10 extending in forward and rearward directions or running direction of the vehicle 1, a pair of left and right steering sleds 13 horizontally movably disposed under a front part (hereinafter referred to as "the front frame section") 10*a* of the body frame 10, and a driving crawler 16 for circulating a track belt 15 disposed under a rear part (hereinafter referred to as "the rear frame section") 10*b* of the body frame 10. The crawler 16 includes a pair of left and right drive wheels 17 disposed in the vicinity of a front end of the rear frame section 10*b*, a pair of left and right driven wheels 18 disposed in the vicinity of a rear end of the rear frame section 10*b*, a pair of left and right intermediate wheels 19, a suspension mechanism 20 that suspends and cushions these pairs of wheels, and the track belt 15 stretched over the wheels for turning around them.

The body frame 10 has a monocock structure. The front frame section 10*a* in which the engine 2 is installed is shaped generally like a boat bottom which progressively narrows toward the front in plan view, with an open top, and the front frame section 10*a* is covered with an engine hood 29 from above.

The front frame section 10*a* has a front part thereof formed as a sled housing section 41 protruding upward. The sled housing section 41 accommodates a suspension and steering mechanism 42. Further, a track housing 11 that accommodates a front part (above the drive wheel 17) of the crawler 16 is formed continuously and integrally with the rear frame section 10*b*.

The rear frame section 10*b* also plays the role of a cover accommodating the whole crawler 16 as viewed from above. A cradle-shaped seat 22 is disposed above the rear frame section 10*b*, and on opposite lateral sides of the seat 22 in a transverse direction of the vehicle body (body frame 10), there are provided running boards 23 (left and right running boards 23L and 23R) which are one step lower than the seat 22(refer to FIG. 3). At an approximately central location in the transverse direction of the vehicle body between the seat 22 and the front frame section 10*a*, a steering post 25 is erected in a fashion extending rearwardly aslant, and a steering bar or handle bar 26 horizontally extends from the upper end of the steering post 25 in the transverse direction. The steering sleds 13 are operated via the steering post 25 by the steering bar 26.

In the vicinity of the steering bar 26 and in front thereof, an instrument panel 27 is provided. Further, a wind shield 28 extends aslant in front of the instrument panel 27 with its upper edge rearwardly located so as to cover the front side of the instrument panel 27 over the entire transverse size thereof. The engine hood 29 gently slopes down in generally streamlined fashion and is shaped generally like a boat bottom upside down. In the vicinity of a stepped border between the engine hood 29 and the instrument panel 27, a headlight 31 is disposed for illuminating ahead of the vehicle. The engine room 30 is defined under the instrument panel 27 and the engine hood 29 thus arranged.

Next, a description will be given of the construction of the engine 2 installed in the engine room 30.

Referring to FIG. 2, the engine 2 is a two-cylinder four-cycle engine with cylinder heads 4 thereof located on a top side thereof, and is disposed close to the steering post 25. The engine 2 has a crankshaft 7 extending substantially parallel to the transverse direction of the vehicle body (refer to FIG. 3), and is disposed with the cylinder heads 4 tilted rearward of the vehicle body. With this disposition, the overall height of the engine is made so low that the engine hood 29 does not block an illumination light path from the headlight 31.

As shown in FIG. 3, a clutch mechanism 38 is disposed at a location leftward of the crankshaft 7 and in a left side part of the engine room 30. The clutch mechanism 38 is implemented e.g. by a V-belt continuously variable transmission with a centrifugal clutch incorporated therein, and is configured to transmit a driving force to the track belt 15 via its gears on the driven side.

As shown in FIG. 2, at a location in the upper part of the engine 2 and slightly rearward of the head cover 8, there is disposed a throttle body 57. An exhaust passage 36 extends in a front part of the engine 2, and an exhaust muffler, not shown, is connected to the exhaust passage 36. Thus, the snow vehicle 1 has the front side of the engine 2 as an exhaust side and the rear side of the engine 2 as an intake side.

As shown in FIGS. 2 and 3, a battery 51 is disposed on the right side of the engine 2. Further, in a rear part of the engine room 30, there is disposed a fuel tank 55 at a location rearward of the steering post 25. An oil tank 59 is disposed in a rear right-hand part of the engine room 30.

The snow vehicle 1 employs a dry sump lubricating structure, and, as described in detail hereinafter, the engine 2 is provided with a feed oil pump (hereinafter referred to as "the oil pump") (oil supply pump) FEP for feeding lubricating oil, and a scavenging oil pump (hereinafter referred to as "the oil pump") (oil recovery pump) SCP for recovering lubricating oil. As shown in FIG. 2, there are provided an oil pipe 53 for returning lubricating oil from the oil pump SCP to the oil tank 59, and an oil pipe 54 for feeding lubricating oil to the oil pump FEP.

Figure 4:
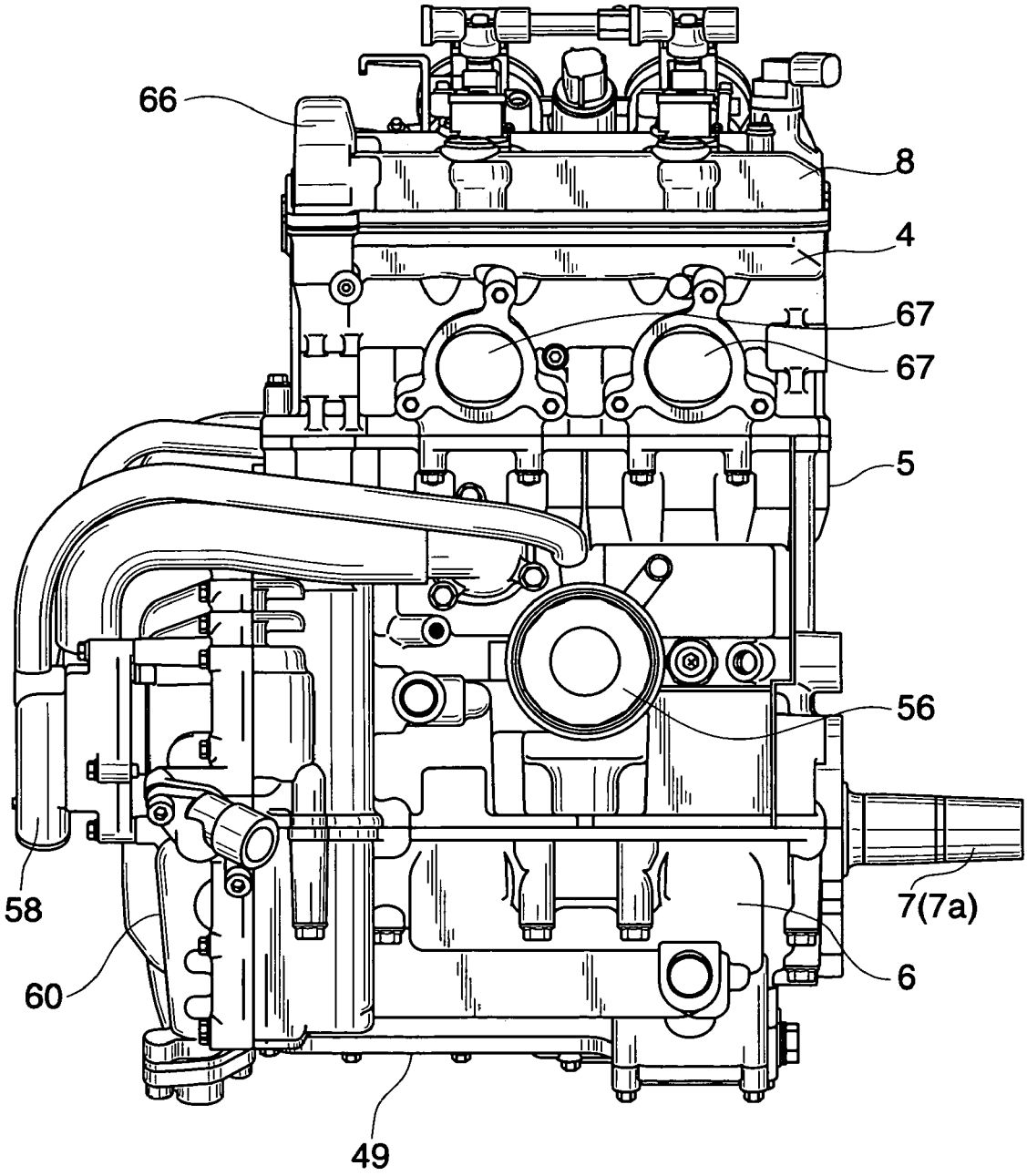
FIG. 4 is a front view showing the engine.
Figure 5:
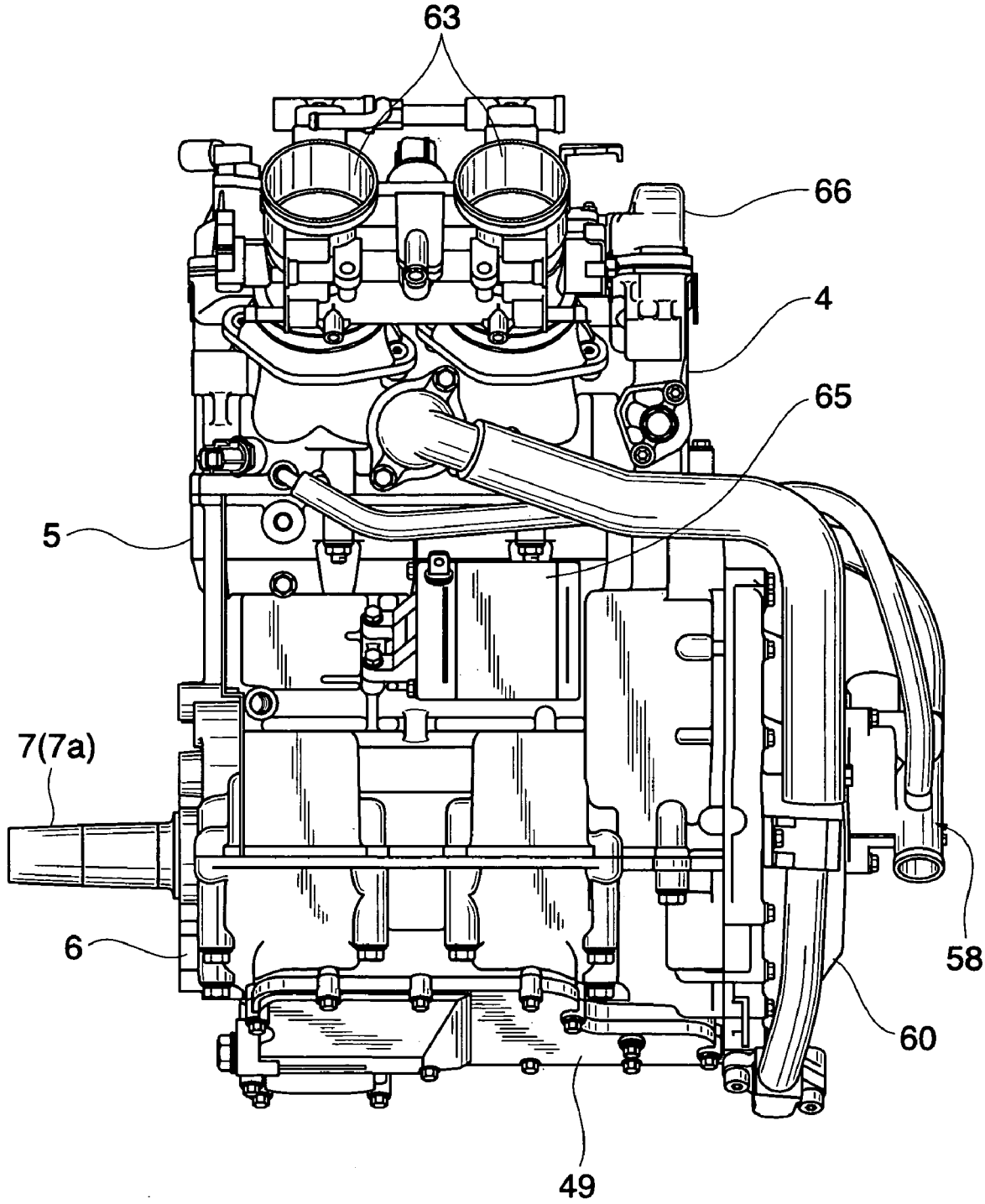
FIG. 5 is a rear view showing the engine.
Figure 6:
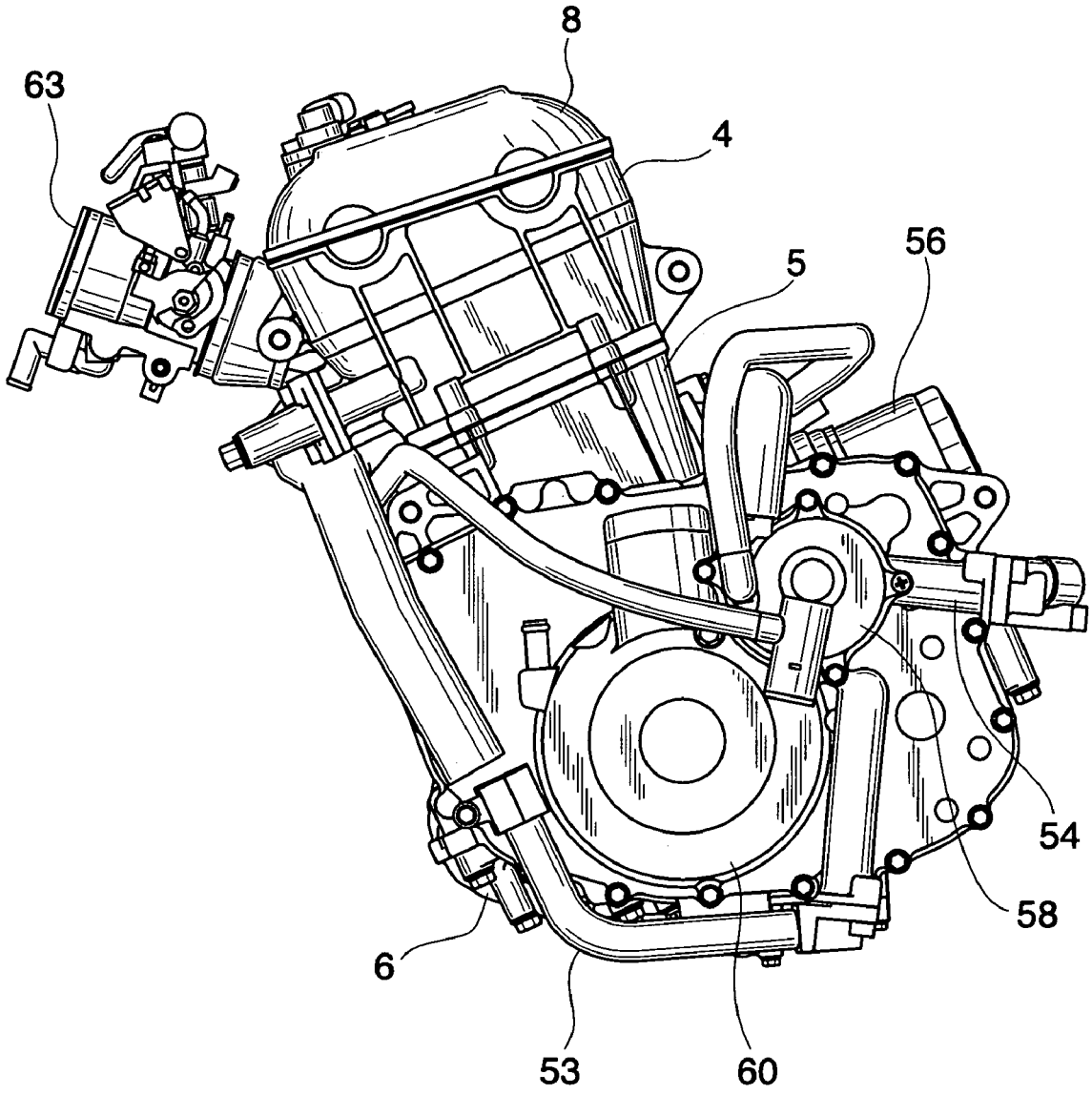
FIG. 6 is a right-side view showing the engine.

FIG. 4 is a front view showing the engine 2. FIG. 5 is a rear view showing the same. FIG. 6 is a right-side view showing the engine 2, and FIG. 7 a left-side view showing the same.

As shown in FIGS. 4, 5, the crankshaft 7 is rotatably supported between an upper crankcase 5, which serves as a cylinder block, and a lower crankcase 6, and disposed such that an output shaft (PTO; one end) 7a of the crankshaft 7 extends leftward. The upper crankcase 5 is disposed under the cylinder heads 4, and an oil pan 49 is disposed under the lower crankcase 6. Further, on the right side of the engine 2, there are provided a water pump 58 and a magnet cover 60. The magnet cover 60 is fixed to right side parts of the respective upper and lower crankcases 5 and 6. The head cover 8 has a right part (left part as viewed in FIG. 4) thereof forming a cam chain chamber 66.

Figure 7:
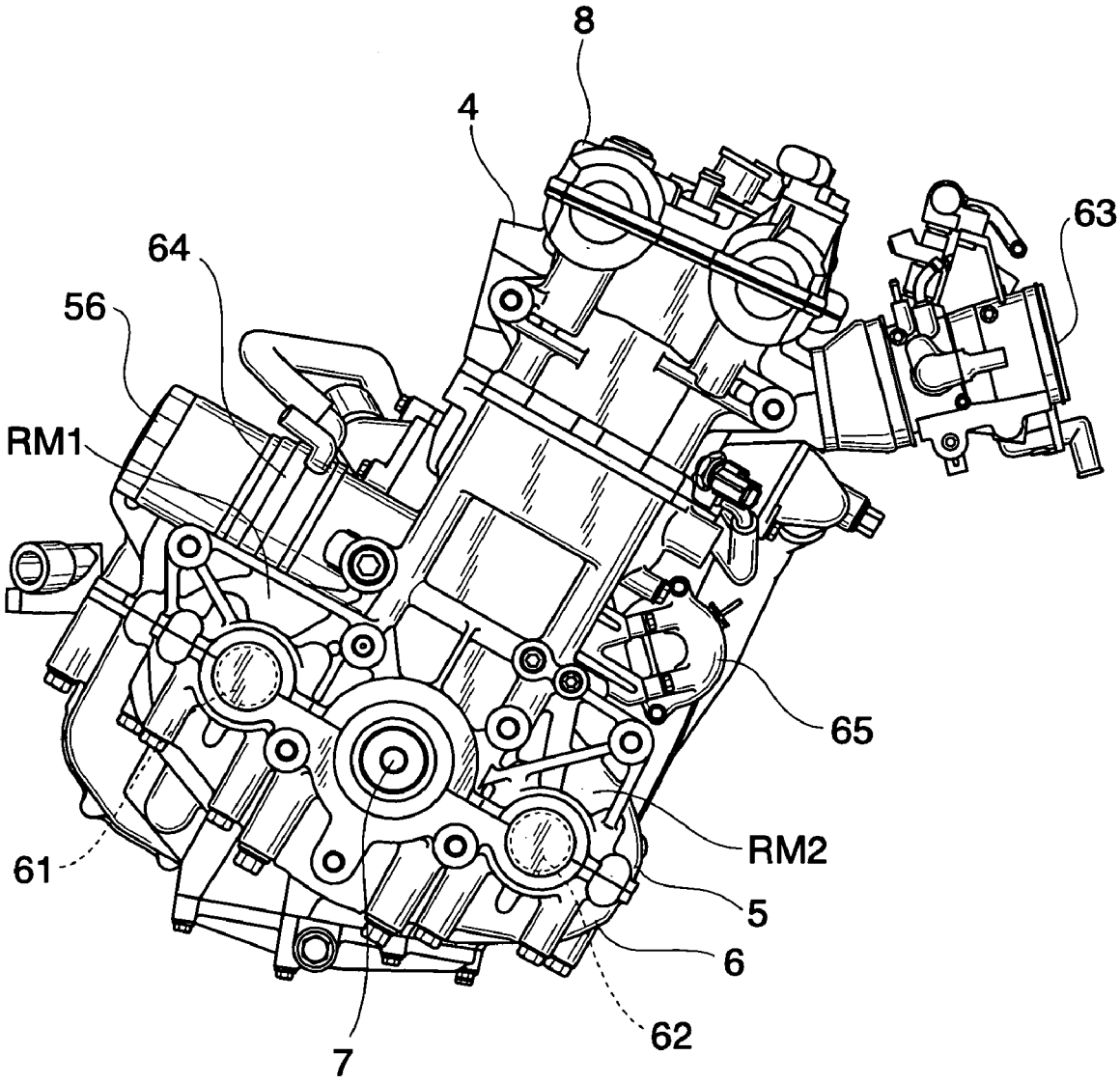
FIG. 7 is a left-side view showing the engine.

As shown in FIG. 7, a front balancer shaft 61 and a rear balancer shaft 62 are disposed at respective locations forward and rearward of the crankshaft 7, and extend substantially parallel to the crankshaft 7. The front and rear balancer shafts 61 and 62 are rotatably supported between the upper crankcase 5 and the lower crankcase 6, together with the crankshaft 7. Further, as shown in FIGS. 5 and 7, a starter motor 65 is provided above the rear balancer shaft 62 in a rear part of the engine 2.

As shown in FIGS. 4, 6 and 7, an oil filter 56 and a water-cooled oil cooler 64 are provided in a front part of the engine 2. The oil filter 56 is disposed substantially above the front balancer shaft 61 and mounted to the upper crankcase 5 via the oil cooler 64.

Figure 8:
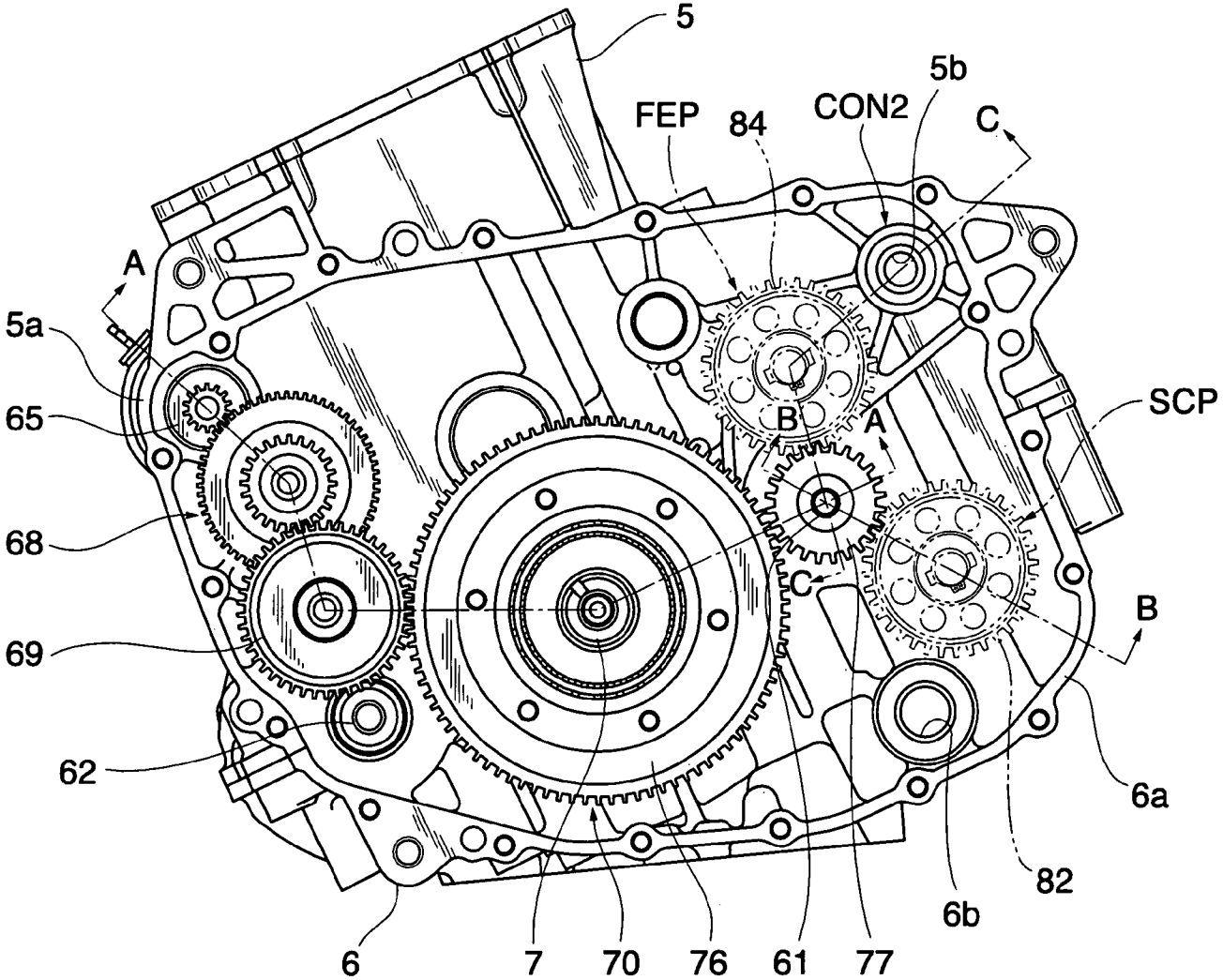
FIG. 8 is a right-side view showing an upper crankcase and a lower crankcase with a magnet cover and oil pumps removed therefrom.
Figure 9:
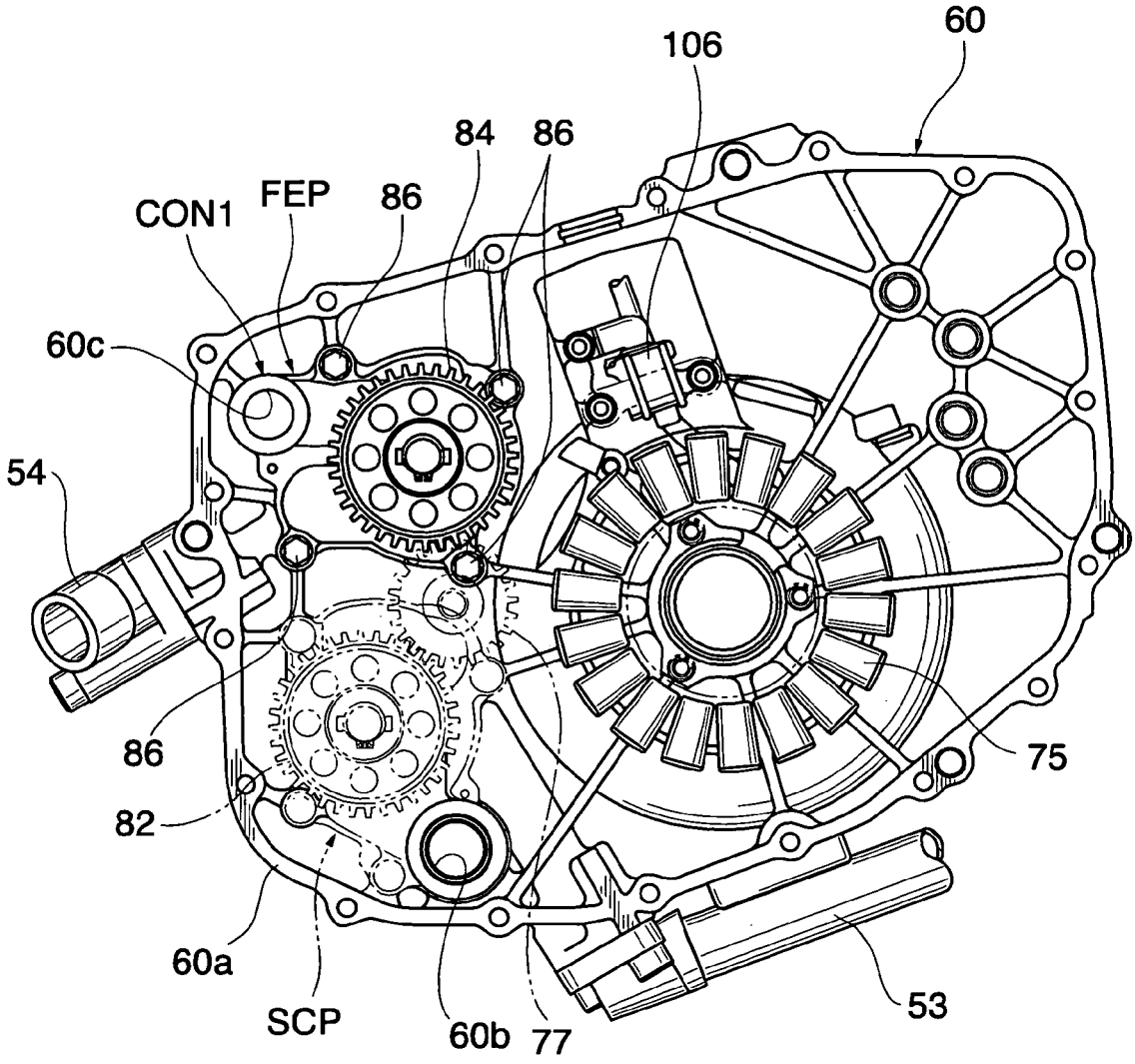
FIG. 9 is a left-side view showing the magnet cover.
Figure 10:
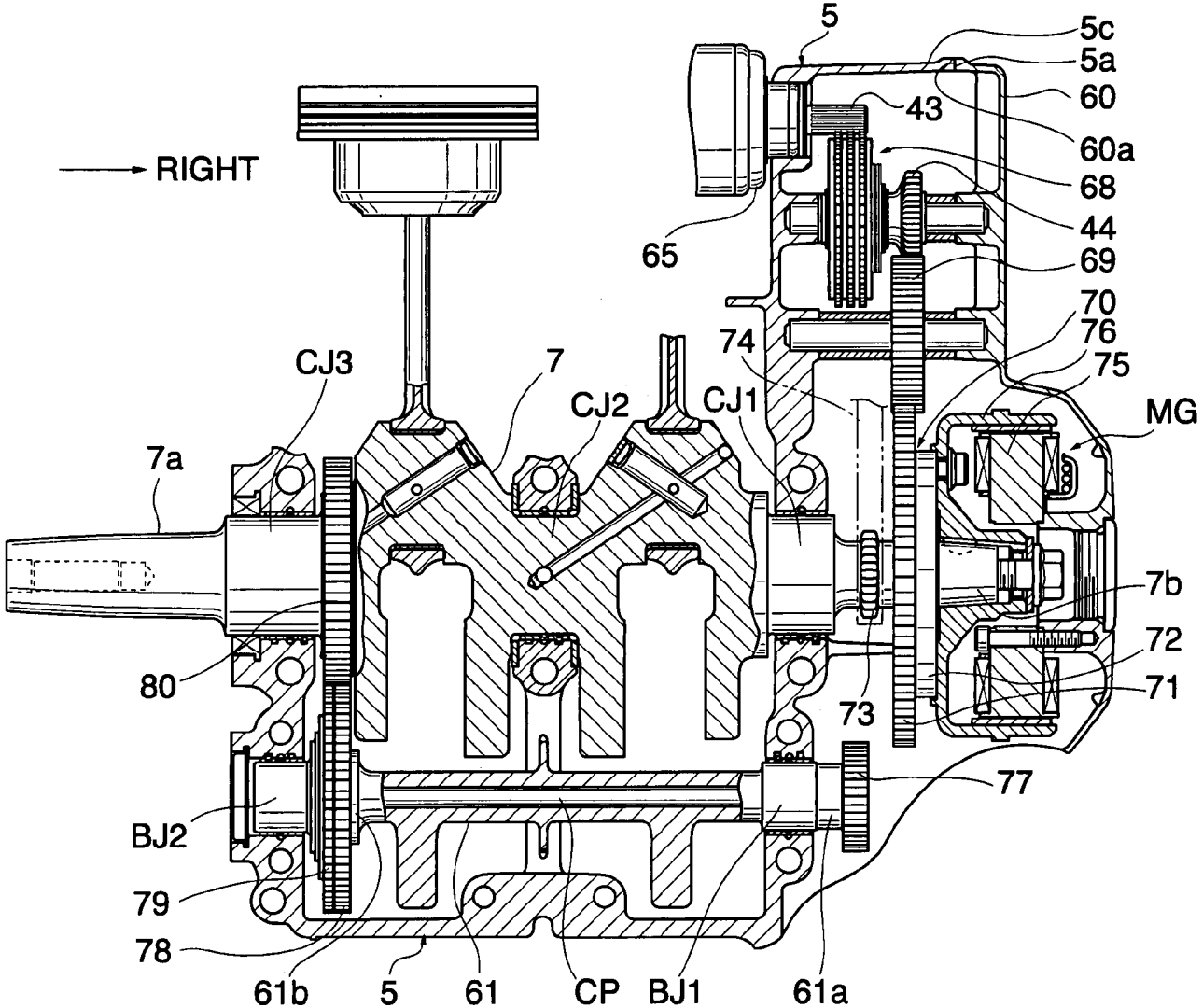
FIG. 10 is a cross-sectional view taken on line A—A of FIG. 8.
Figure 11:
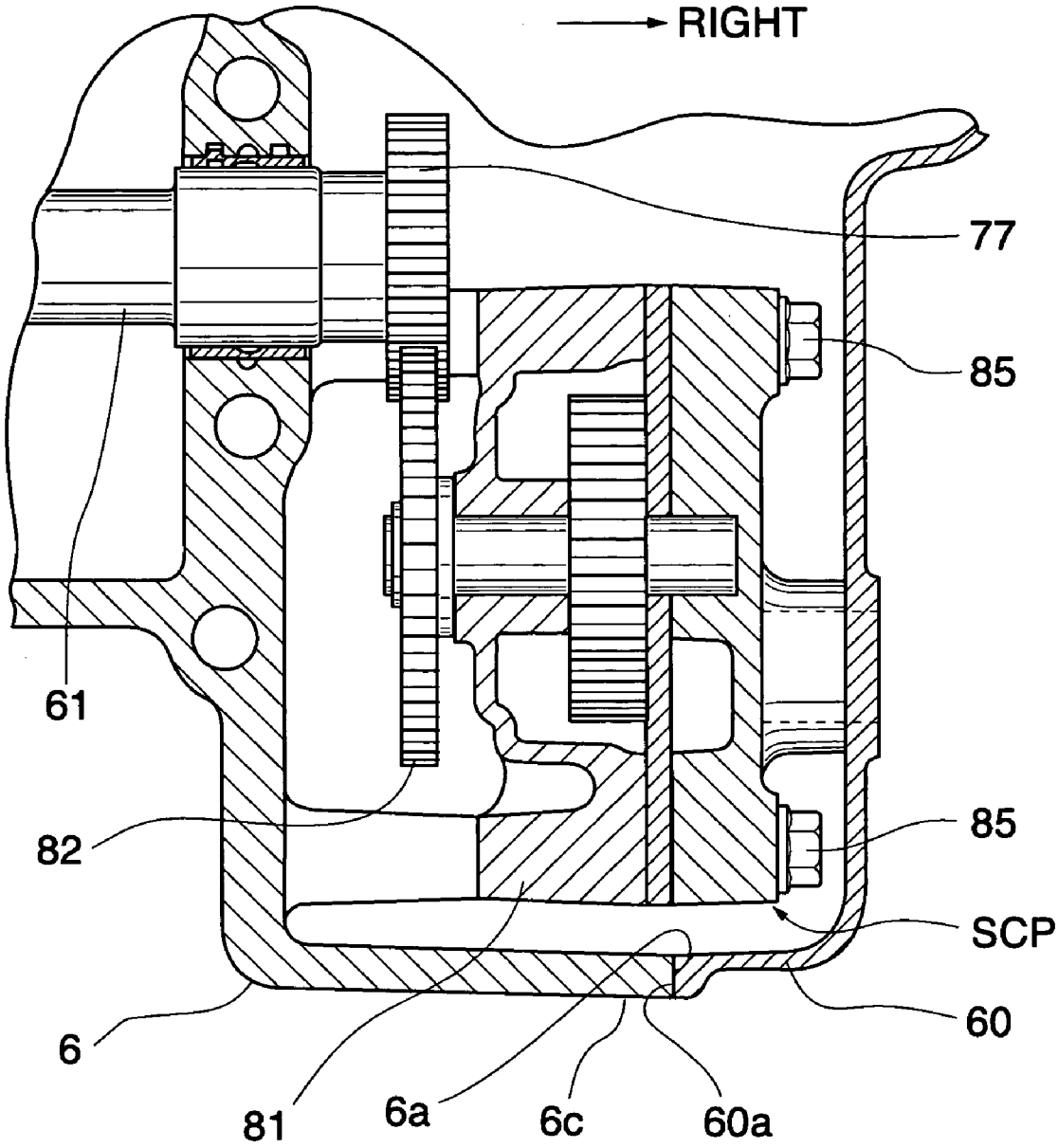
FIG. 11 is a cross-sectional view taken on line B—B of FIG. 8.

FIG. 8 is a right-side view showing the upper crankcase 5 and the lower crankcase 6, with the magnet cover 60 and the oil pump SCP removed therefrom. FIG. 9 is a left-side view showing the magnet cover 60. FIG. 10 is a cross-sectional view taken on line A—A of FIG. 8. FIG. 11 is a cross-sectional view taken on line B—B of FIG. 8.

As shown in FIGS. 10 and 11, the magnet cover 60 is mounted on right-side parts 5*c* and 6*c* of the respective crankcases 5 and 6. When the magnet cover 60 is fixed onto the crankcases 5 and 6, a joint surface 5*a* (refer to FIGS. 8 and 10) of the upper crankcase 5 and a joint surface 6*a* (refer to FIGS. 8 and 11) of the lower crankcase 6 come into contact with a joint surface 60*a* (refer to FIGS. 9, 10 and 11) of the magnet cover 60 in facing relation.

Referring to FIG. 10, the crankshaft 7 is rotatably supported at its first to third journals CJ1 to CJ3. The front balancer shaft 61 is rotatably supported at its first and second journals BJ1, BJ2, and although not shown, the rear balancer shaft 62 is supported similarly to the front balancer shaft 61.

As shown in FIG. 10, the front balancer shaft 61 has first and second balancer shaft driven gears 78 and 79 rigidly fitted on a left end 61*b* thereof, and an oil pump drive gear 77 rigidly fitted on a right end 61*a* thereof. The crankshaft 7 has a balancer shaft drive gear 80 fitted thereon at a location rightward of the third journal CJ3 so that rotation of the crankshaft 7 is transmitted to the front balancer shaft 61 via the balancer shaft drive gear 80 and the first and second balancer shaft driven gears 78 and 79.

The crankshaft 7 has a cam sprocket 73 rigidly mounted on a right end part (another end) 7*b* thereof opposite from the output shaft 7*a*, and a cam chain 74 is passed over the cam sprocket 73 to transmit the driving force to camshafts 110, as shown in FIG. 13. Also mounted on the right end 7*b* of the crankshaft 7 substantially in concentricity with the crankshaft 7 is a starter clutch section 70 which is comprised of a starter one-way gear 71 and a starter one-way clutch 72.

At a location rightward of the starter clutch section 70, there is provided a magnet (magnet device) MG for power generation. The magnet MG is disposed between the two crankcases 5 and 6 and the magnet cover 60. The magnet MG is comprised of a magnet flywheel 76, a magnet stator 75, and a pulser coil 106 (refer to FIG. 9). The magnet flywheel 76 is mounted on the right end 7*b* of the crankshaft 7, for rotation in unison with the crankshaft 7. The magnet stator 75 and the pulser coil 106 are fixed to the magnet cover 60.

The starter one-way clutch 72 is disposed between the cam sprocket 73 and the magnet MG, and fixed to the magnet flywheel 76. The starter one-way clutch 72 has a ratchet structure that transmits rotation of the starter one-way gear 71 to the crankshaft 7, but inhibits transmission of rotation of the crankshaft 7 to the starter one-way gear 71.

Further, as shown in FIG. 8, above the rear balancer shaft 62, there are disposed a starter gear 69, a starter limiter 68, and a starter motor 65 in the mentioned order from below and in a substantially linear arrangement, as viewed from a lateral side of the engine (or as viewed in an-axial direction of the crankshaft 7). The starter limiter 68 transmits the driving force within a predetermined range.

As the starter motor 65 rotates for starting the engine 2, the rotation of the starter motor 65 is transmitted from a pinion gear 43 (refer to FIG. 10) of the starter motor 65 to the starter one-way gear 71 via the starter limiter 68, a drive gear 44 formed integrally with the starter limiter 68, and the starter gear 69. Since the starter one-way gear 71 and the starter one-way clutch 72 are formed integrally with each other, rotation of the starter one-way gear 71 is transmitted to the right end 7*b* of the crankshaft 7 via the starter one-way clutch 72 and the magnet flywheel 76, whereby the crankshaft 7 is driven for rotation to start the engine 2.

As shown in FIGS. 8 and 9, the oil pump FEP and the oil pump SCP are disposed above and below the front balancer shaft 61, respectively, and mounted between the two crankcases 5 and 6 and the magnet cover 60.

As shown in FIG. 11, the oil pump SCP is comprised of an SC pump body (oil pump body) 81 and an SC pump driven gear (oil pump driven gear) 82, and is fixed to the lower crankcase 6 by a plurality of bolts 85. The SC pump driven gear 82 is in mesh with the oil pump drive gear 77, so that the oil pump SCP is driven by the front balancer shaft 61 via the oil pump drive gear 77.

As shown in FIG. 8, the lower crankcase 6 has an oil suction hole 6*b* formed therein at a location below the oil pump SCP, and an oil suction hole 60*b* associated with the oil suction hole 6*b* is formed through the magnet cover 60 (refer to FIG. 9). Lubricating oil stored in the oil pan 49 (refer to FIGS. 4 and 5) is returned by the oil pump SCP through the oil suction hole 6*b* and the oil suction hole 60*b*, to be collected in the oil tank 59 through the oil pipe 53. Subsequently, the lubricating oil is guided from the oil tank 59 to the oil pump FEP through the oil pipe 54 (refer to FIGS. 2 and 3).

Figure 12:
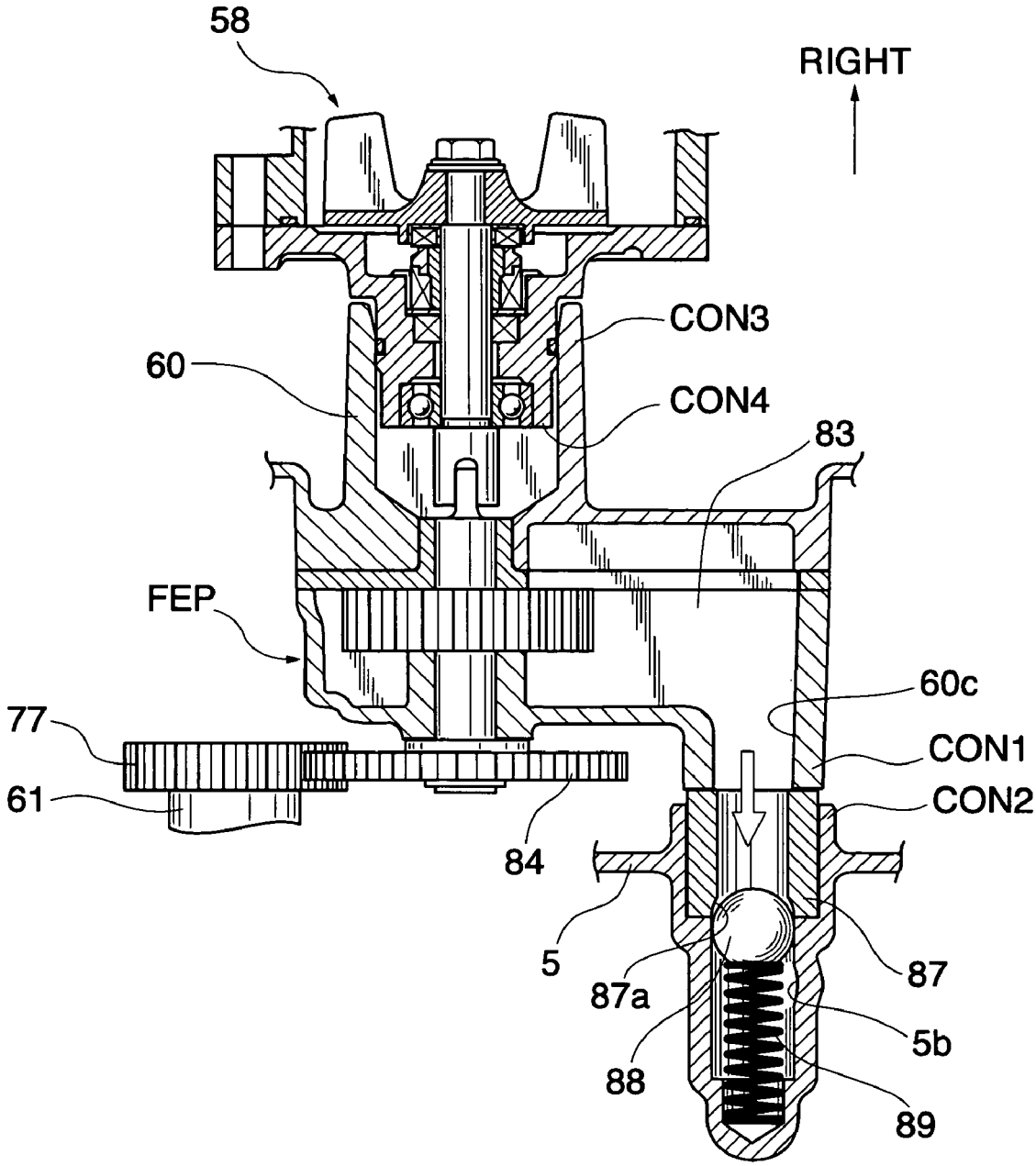
FIG. 12 is a cross-sectional view taken on line C—C of FIG. 8.

FIG. 12 is a cross-sectional view taken on line C—C of FIG. 8. The oil pump FEP is comprised of an FE pump body (oil pump body) 83 and an FE pump driven gear (oil pump driven gear) 84, as shown in FIG. 12, and is fixed to the magnet cover 60 by a plurality of bolts 86 (refer to FIG. 9). The FE pump driven gear 84 is in mesh with the oil pump drive gear 77, so that the oil pump FEP is driven by the front balancer shaft 61 via the oil pump drive gear 77.

The SC pump driven gear 82 and the FE pump driven gear 84 are both generally identical in position in the axial direction of the front balancer shaft 61, to the oil pump drive gear 77. Insofar as the positional relationship between these components in the axial direction of the front balancer shaft 61 is concerned, the SC pump driven gear 82 is disposed closer to the axial center CP (refer to FIG. 10) of the front balancer shaft 61 than the SC pump body 81 is, and similarly, the FE pump driven gear 84 is disposed closer to the axial center CP than the FE pump body 83 is. Further, the oil pump drive gear 77 is offset to the axial center CP of the front balancer shaft 61 relative to the starter one-way gear 71. With the arrangement described above, it is possible to suppress rightward protrusion of the magnet flywheel 76, thereby contributing to reduction of the overall width of the engine 2. Further, the offset between the oil pump drive gear 77 and the starter one-way gear 71 makes it possible to increase the degree of freedom in the gear diameters of the gears 77 and 71.

As shown in FIG. 12, the water pump 58 is disposed in concentricity with the oil pump FEP at a location rightward of the same. A fitted part CON4 of the water pump 58 is fitted in a water pump mounting part CON3 of the magnet cover 60, whereby the water pump 58 is held in a state rigidly secured to the magnet cover 60, for being driven together with the oil pump FEP. A connecting part CON1 of the magnet cover 60 is opposed to a connecting part CON2 of the upper crankcase 5.

As shown in FIG. 8, the connecting part CON2 of the upper crankcase 5 is formed therein with a hole 5*b* for introducing lubricating oil into the engine 2. On the other hand, as shown in FIG. 9, the connecting part CON1 of the magnet cover 60 is formed therein with a hole 60*c* as a lubricating oil discharge port of the oil pump FEP. Referring again to FIG. 12, the connecting part CON2 is provided with a sealing resilient member 87 formed e.g. of rubber, a backflow-preventive ball 88, and a spring 89, which are arranged in the mentioned order from the magnet cover side. The sealing resilient member 87 has a ball-seating portion 87*a* against which the backflow-preventive ball 88 can abut. The spring 89 constantly urges the backflow-preventive ball 88 toward the sealing resilient member 87. The sealing resilient member 87 is sandwiched between the connecting part CON1 and the connecting part CON2, so that no special fixing member is needed, which simplifies the construction of the sealing resilient member 87.

When lubricating oil fed under pressure is delivered from the oil pump FEP into the connecting part CON2 via the hole 60*c* of the connecting part CON1, the backflow-preventive ball 88 moves away from the sealing resilient member 87 against the resilient force of the spring 89. Then, the lubricating oil flows into the hole 5*b* through a gap created between the backflow-preventive ball 88 and the sealing resilient member 87, to be supplied into the engine 2. On the other hand, when lubricating oil starts to flow from the hole 5*b* toward the hole 60*c*, the resilient force of the spring 89 urges the backflow-preventive ball 88 into contact with the ball-seating portion 87*a* of the sealing resilient member 87, to seal between the backflow-preventive ball 88 and the sealing resilient member 87. This makes it possible to prevent backflow of lubricating oil during stoppage of the engine and entry of lubricating oil from the oil tank 59 side.

FIG. 13 is a longitudinal cross-sectional view showing the engine 2. FIG. 14 is a cross-sectional view taken on line D—D of FIG. 13. FIG. 15 is a cross-sectional view taken on line E—E of FIG. 14, and FIG. 16 a cross-sectional view taken on line F—F of FIG. 14.

As shown in FIGS. 7 and 13, the front balancer shaft 61 and the rear balancer shaft 62 are accommodated, respectively, in a balancer chamber RM1 and the balancer chamber RM2, each defined by joining parts (connecting parts) of the upper and lower crankcases 5 and 6. The oil filter 56 is disposed above the balancer chamber RM1 in a manner facing obliquely upward. The engine 2 is tilted rearward such that a space is formed in the vicinity of the front part of the upper half of the engine 2. Therefore, by disposing the oil filter 56 in this space, it is possible to prevent forward projection of the oil filter 56 and interference of the same with other component parts, and also save space. Further, the oil filter 56 is disposed above the front balancer shaft 61 positioned at a location elevated by the inclination of the engine 2, which makes the oil filter 56 higher in position, and what is more, in a manner facing obliquely upward. This disposition of the oil filter 56 facilitates replacement operation e.g. for periodical replacement thereof.

As shown in FIGS. 13 and 14, a main oil gallery 90 is formed in the upper crankcase 5 at a location forward of the cylinders 94 (94L and 94R). The main oil gallery 90 extends in the transverse direction in a front part 5*d* of the upper crankcase 5. The main oil gallery 90 is in communication with an oil passage 92 into which oil flows from the oil filter 56. Further, a sub oil gallery 91 is formed on an opposite side of the upper crankcase 5 from the main oil gallery 90. More specifically, the sub oil gallery 91 extends in the transverse direction in a rear part 5*e* of the upper crankcase 5 at a location rearward of the cylinders 94L and 94R.

Further, as shown in FIG. 14, oil communication passages 95 (95A and 95B) are formed in a left side part 5*f* of the upper crankcase 5 at a location leftward of the cylinder 94L. The oil communication passages 95A and 95B extend substantially along the cylinder 94L in a fashion surrounding the cylinder 94L. With this arrangement, space is saved in the transverse direction of the upper crankcase 5. The main oil gallery 90 and the sub oil gallery 91 communicate with each other via the oil communication passages 95A and 95B.

Referring to FIG. 15, the upper crankcase 5 is formed therein with first to fourth oil passages 97 to 100. Further, the upper crankcase 5 is formed with a balancer shaft-bearing part 101 rotatably supporting the first journal BJ1 (refer to FIG. 10) of the front balancer shaft 61, a crankshaft-bearing part 103 rotatably supporting the first journal CJ1 (refer to FIG. 10) of the crankshaft 7, and a balancer shaft-bearing part 102 rotatably supporting a first journal, not shown, of the rear balancer shaft 62.

The first oil passage 97 connects between the main oil gallery 90 and the balancer shaft-bearing part 101, and the second oil passage 98 connects between the main oil gallery 90 and the crank-bearing part 103. The third oil passage 99 (one of third oil passages recited in appended claims) and the fourth oil passage 100 (one of the third oil passages recited in appended claims) connect between the crank-bearing part 103 and the balancer shaft-bearing part 102.

Lubricating oil from the main oil gallery 90 flows into the balancer shaft-bearing part 101 through the first oil passage 97 to lubricate the first journal BJ1 of the front balancer shaft 61. The Lubricating oil from the main oil gallery 90 also flows into a gap 105 between a bearing metal 104 of the crank-bearing part 103 and the upper crankcase 5 through the second oil passage 98 to lubricate the first journal CJ1 of the crankshaft 7. Further, the lubricating oil flows into the third oil passage 99 as well. The lubricating oil having flown into the third oil passage 99 further flows into the balancer shaft-bearing part 102 through the fourth oil passage 100 to lubricate the first journal of the rear balancer shaft 62.

The first to fourth oil passages 97 to 100 are arranged in a generally M-shaped array, as viewed in the axial direction of the crankshaft 7. With this arrangement, the oil passages are formed in an efficiently concentrated fashion, whereby passage machining is facilitated, and at the same time the balance of supply of lubricating oil to the bearing parts is improved.

Although FIG. 15 illustrates only the lubricating structure for each of the first journals (CJ1, BJ1, etc.), the upper crankcase 5 has oil passages (not shown) arranged in a generally M-shaped array similarly to the first to fourth oil passages 97 to 100 at a location corresponding to the third journal CJ3 of the crankshaft 7 and the second journal BJ2 (refer to FIG. 10) of the front balancer shaft 61. Further, at a location corresponding to the second journal CJ2 (refer to FIG. 10) of the crankshaft 7, there are formed only two oil passages (not shown) which are similar to the second and fourth passages 98 and 99.

As shown in FIG. 16, a piston cooling jet 93 is connected to the sub oil gallery 91 and directed toward the cylinder 94R. Also at a location corresponding to the cylinder 94L, there is provided a piston cooling jet (not shown) similar to the piston cooling jet 93. Further, at a location obliquely forward of and slightly below the main gallery 90, there is formed a guide passage 96 for guiding lubricating oil delivered under pressure from the oil pump FEP to the oil filter 56.

The lubricating oil fed under pressure from the oil pump FEP and having passed through the connecting part CON2 (refer to FIGS. 8 and 12) flows through the guide passage 96 into the oil filter 56 via a relief valve, not shown. Then, the lubricating oil flows from the oil filter 56 through the main oil gallery 90, whereafter part of the lubricating oil flows into the first to fourth oil passages 97 to 100, as mentioned above, and the remaining part of the same flows through the sub oil gallery 91, and is injected from the piston cooling jet 93 for lubricating the interior of the cylinder 94R (including the associated piston). The cylinder 94L is similarly lubricated by the corresponding piston cooling jet, not shown.

Further, as shown in FIG. 16, the upper crankcase 5 is formed therein with a cooling water jacket 5*g*. The cooling water jacket 5*g* is formed in the rear part 5*e* of the upper crankcase 5 at a location rearward of the cylinder 94R in a fashion extending downward substantially vertically to a location adjacent to the sub oil gallery 91. This improves the cooling performance of the cooling water jacket 5*g*, and hence oil in the sub oil gallery 91 is cooled sufficiently to thereby improve the performance of cooling the pistons and the performance of cooling the interior of the cylinders.

According to the present embodiment, in the dry sump lubricating structure in which the clutch mechanism 38 is disposed on the output shaft 7*a* side of the crankshaft 7 and the magnet MG is mounted on the right end part 7*b* opposite from the output shaft 7*a*, the oil pump FEP and the oil pump SCP are disposed between the two crankcases 5 and 6 and the magnet cover 60, which makes it possible to avoid interference between the oil pumps FEP and SCP and the clutch mechanism 38 as well as to suppress an increase in the size of the engine 2. In particular, since the oil pump FEP is fixed to the magnet cover 60, the overall width of the engine 2 can be easily reduced. The oil pump SCP may also be fixed to the magnet cover 60, not to the upper crankcase 5.

Further, since the oil pump FEP and the oil pump SCP are driven by the front balancer shaft 61, it is not only possible to use smaller-sized gears as the FE pump driven gear 84 and the SC pump driven gear 82 than in the case where the two pumps are driven by the crankshaft 7, but also it can be avoided that the crankshaft 7 is lengthened so as to take out a driving force therefrom, which makes it possible to suppress the overall width of the engine 2. Furthermore, the FE pump driven gear 84 and the SC pump driven gear 82 are disposed closer to the axial center CP of the front balancer shaft 61, than the FE pump body 83 and the SC pump body 81, which makes it possible to prevent protrusion of the magnet flywheel 76, thereby suppressing the overall width of the engine 2.

Moreover, according to the present embodiment, in the lubricating structure for an engine for a snow vehicle,.the main oil gallery 90 and the sub oil gallery 91 are located between the joint surface of the upper crankcase 5 at which it is joined to the cylinder head 4 and the joint surface of the same at which it is joined to the lower crankcase 6, and the oil communication passages 95A and 95B are formed at a location leftward of the cylinder 94L and remotest from the oil pump FEP and the oil pump SCP such that the oil communication passages 95A and 95B extend along the cylinder 94L in a fashion surrounding the cylinder 94L. Therefore, it is possible to easily avoid interference between the oil communication passages 95A and 95B and head fastening bolts, not shown, and lower case fastening bolts, not shown. Further, space can be effectively used to form the passages, which also contributes to suppression of an increase in the size of the engine 2.

Furthermore, according to the present embodiment, in the lubricating structure for an engine for a snow vehicle provided with two balancer shafts, the first to fourth oil passages 97 to 100 are arranged in a generally M-shaped array so as to supply lubricating oil to the balancer shaft-bearing part 101 and the crankshaft-bearing part 103 from the main oil gallery 90 as well as to supply lubricating oil to the balancer shaft-bearing part 102 via the crankshaft-bearing part 103, that is, the oil passages are arranged in an efficiently concentrated and simplified fashion, which makes it possible not only to supply lubricating oil to the bearing parts in a well-balanced manner without increasing the size of the engine, but also to facilitate machining the oil passages.

Moreover, according to the present embodiment, in the engine 2 tilted rearward, the oil filter 56 is disposed above the front balancer shaft 61 in a manner facing obliquely upward, which makes it possible not only to avoid interference between the oil filter 56 and other components, but also to facilitate replacement operation of the oil filter 56 e.g. for periodical replacement thereof.

Although in the present embodiment, the oil tank 59 is disposed in the rear right-hand part of the engine room 30 so as to reduce the distance between the oil tank 59 and the oil pumps SCP and FEP to thereby facilitate piping, this is not limitative, insofar as the oil tank 59 is disposed at a location remote from the clutch mechanism 38, where piping between the oil tank 59 and the two oil pumps SCP and FEP is facilitated. More specifically, it is preferable that the oil tank 59 is disposed rightward of the transverse center CL (refer to FIG. 3) of the vehicle body.

The arrangement of the two oil pumps SCP and FEP in the present embodiment can also be applied to engines for small vehicles other than snow vehicles, insofar as the oil pumps SCP and FEP are disposed so as to avoid interference with the clutch mechanism 38 and an increase in the size of the engine 2.

Although in the present embodiment, only the oil pump FEP of the two pumps SCP and FEP is fixed to the magnet cover 60, the oil pump SCP or the two oil pumps SCP and FEP may be fixed to the magnet cover 60 insofar as the overall width of the engine can be reduced.

Further, in the present embodiment, the oil communication passages 95A and 95B are formed at a location leftward of the cylinder 94L, but when the two oil pumps SCP and FEP are disposed in a left part of the engine 2, the oil communication passages 95A and 95B may be formed at a location opposite from the left part, i.e. rightward of the cylinder 94R, which can also reduce the overall width of the engine.

In the present embodiment, since the engine 2 is tilted rearward, the oil filter 56 is disposed above the front balance shaft 61, but when the engine 2 is tilted forward, the oil filter 56 may be disposed above the rear balance shaft 62, which facilitates replacement of the oil filter 56.

What is claimed is:

1. A lubricating structure for an engine, comprising:

a crankshaft (7) having one end (7*a*) and another end (7*b*);

at least one crankcase (5, 6) having opposite side parts and rotatably supporting said crankshaft;

a clutch mechanism (38) disposed at a location toward said one end of said crankshaft;

a magnet cover (60) fixed to one of said opposite side parts of said crankcase, which is remote from said clutch mechanism;

a magnet device (MG) disposed between said crankcase and said magnet cover at a location toward said other end of said crankshaft;

an oil supply pump (FEP) disposed between said crankcase and said magnet cover, for supplying lubricating oil; and an oil recovery pump (SCP) disposed between said crankcase and said magnet cover, for recovering the lubricating oil.

2. A lubricating structure as claimed in claim 1, wherein at least one of said oil supply pump and said oil recovery pump is fixed to said magnet cover.

3. A lubricating structure as claimed in claim 1, further comprising a balancer shaft (61) extending substantially parallel to said crankshaft, and wherein said oil supply pump and said oil recovery pump are driven by said balancer shaft.

4. A lubricating structure as claimed in claim 3, wherein said balancer shaft has an end (61*a*) remote from said clutch mechanism, the lubricating structure further comprising an oil pump drive gear (77) rigidly fitted on said end of said balancer shaft, and wherein at least one of said oil supply pump and said oil recovery pump includes an oil pump body (81, 83), and an oil pump driven gear (82, 83), and wherein said oil pump drive gear is disposed at a location closer to an axial center (CP) of said balancer shaft than said oil pump body of said at least one of said oil supply pump and said oil recovery pump is.

5. A lubricating structure for an engine for a snow vehicle, comprising:

an engine having a left side part and a right side part;

a plurality of cylinders (94);

a crankshaft (7) extending through said engine in a transverse direction thereof;

a main oil gallery (90) formed in said engine at one of locations forward and rearward of said plurality of cylinders;

a sub oil gallery (91) formed in said engine at the other of the locations forward and rearward of said plurality of cylinders;

a piston cooling jet (93) connected to said sub oil gallery;

at least one oil pump (FEP, SCP) provided in one of said left side part and said right side part of said engine; and an oil communication passage (95) formed in the other of said left side part and said right side part of said engine on a side of one cylinder remotest from said at least one oil pump, which is opposite from said at least one oil pump, said oil communication passage communicating with said main oil gallery and said sub oil gallery.

6. A lubricating structure as claimed in claim 5, further comprising a cooling water jacket (5*g*) formed in said engine at a location adjacent to said sub oil gallery.

7. A lubricating structure for an engine for a snow vehicle, comprising:

a crankshaft extending through the engine in a transverse direction thereof;

front and rear balancer shafts (61, 62) disposed at respective locations forward and rearward of said crankshaft and extending substantially parallel to said crankshaft;

a crankcase (5) having a crankshaft-bearing part (103), a front balancer shaft-bearing part (101), and a rear balancer shaft-bearing part (102), said crankshaft-bearing part rotatably supporting said crankshaft, said front balancer shaft-bearing part rotatably supporting said front balancer shaft, and said rear balancer shaft-bearing part rotatably supporting said rear balancer shaft;

a main oil gallery (90) formed in said crankcase at a location forward of said crankshaft and extending substantially parallel to said crankshaft;

a first oil passage (97) formed in said crankcase and connecting between said main oil gallery and said front balancer shaft-bearing part;

a second oil passage (98) formed in said crankcase and connecting between said main oil gallery and said crankshaft-bearing part; and at least one third oil passage (99, 100) formed in said crankcase and connecting between said crankshaft-bearing part and said rear balancer shaft-bearing part.

8. A lubricating structure as claimed in claim 7, wherein said first to third oil passages are arranged in a generally M-shaped array, as viewed in an axial direction of said crankshaft.

9. A snow vehicle comprising:

an engine having a front part, and a rear part and tilted longitudinally of the snow vehicle such that one of said front part and said rear part is located upward of the other;

a crankshaft extending through said engine in a transverse direction thereof;

a balancer shaft (61) disposed in the one of said front part and said rear part of said engine, which is located upward, and extending substantially parallel to said crankshaft; and an oil filter (56) disposed above said balancer shaft.

* * * * *